US010763032B2

(12) United States Patent
Kim et al.

(10) Patent No.: US 10,763,032 B2
(45) Date of Patent: Sep. 1, 2020

(54) THIN FILM-TYPE INDUCTOR

(71) Applicant: SAMSUNG ELECTRO-MECHANICS CO., LTD., Suwon-si, Gyeonggi-do (KR)

(72) Inventors: Boum Seock Kim, Suwon-si (KR); Byeong Cheol Moon, Suwon-si (KR); Kang Wook Bong, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 163 days.

(21) Appl. No.: 15/818,505

(22) Filed: Nov. 20, 2017

(65) Prior Publication Data

US 2019/0013142 A1 Jan. 10, 2019

(30) Foreign Application Priority Data

Jul. 5, 2017 (KR) ..... 10-2017-0085288

(51) Int. Cl.

| | |
|---|---|
| ***H01F 27/28*** | (2006.01) |
| ***H01F 27/32*** | (2006.01) |
| ***H01F 17/04*** | (2006.01) |
| ***H01F 17/00*** | (2006.01) |
| *H01F 27/29* | (2006.01) |
| *H01F 27/255* | (2006.01) |

(52) U.S. Cl.

CPC ..... *H01F 27/2804* (2013.01); *H01F 17/0013* (2013.01); *H01F 17/04* (2013.01); *H01F 27/324* (2013.01); *H01F 27/255* (2013.01); *H01F 27/292* (2013.01); *H01F 2017/002* (2013.01); *H01F 2017/048* (2013.01); *H01F 2027/2809* (2013.01)

(58) Field of Classification Search

CPC .. H01F 17/0013; H01F 17/04; H01F 17/0006; H01F 2017/002; H01F 2017/048; H01F 2017/0073; H01F 27/2804; H01F 27/324; H01F 27/292; H01F 27/255; H01F 2027/2809

USPC ..... 336/200, 223, 233, 232

See application file for complete search history.

(56) References Cited

U.S. PATENT DOCUMENTS 5,880,662 A * 3/1999 Person ..... H01F 17/0013 336/192
6,580,350 B1 * 6/2003 Kobayashi ..... H01F 17/0013 336/192

(Continued)

FOREIGN PATENT DOCUMENTS

| | | | |
|---|---|---|---|
| JP | 2015-228478 | A | 12/2015 |
| KR | 10-2009-0010302 | A | 1/2009 |
| KR | 10-1532171 | B1 | 7/2015 |

*Primary Examiner* — Mang Tin Bik Lian

(74) *Attorney, Agent, or Firm* — Morgan, Lewis & Bockius LLP

(57) ABSTRACT

A thin film-type inductor includes a body and a first external electrode and a second external electrode, each disposed on an external surface of the body. The body includes a support member, a first coil, a second coil, a magnetic material surrounding the support member. The first coil is disposed on an upper surface of the support member, and the second coil is disposed on a lower surface of the support member. The support member includes through-hole and a via electrode therein. A portion of one of an upper surface and a lower surface of the via electrode opposes the magnetic material.

18 Claims, 2 Drawing Sheets

(56) References Cited

U.S. PATENT DOCUMENTS

| | | | | |
|---|---|---|---|---|
| 7,327,207 | B2 * | 2/2008 | Asakawa | H01F 17/0013 333/175 |
| 2013/0106554 | A1 * | 5/2013 | Girard | H01F 5/003 336/200 |
| 2016/0111194 | A1 * | 4/2016 | Jeong | H01F 17/0013 336/200 |
| 2017/0111995 | A1 * | 4/2017 | Nishikawa | H01F 27/255 |
| 2017/0133152 | A1 * | 5/2017 | Kouchi | H02J 50/12 |
| 2018/0033725 | A1 * | 2/2018 | Liang | H01L 23/66 |

* cited by examiner

THIN FILM-TYPE INDUCTOR

CROSS-REFERENCE TO RELATED APPLICATION

This application claims the benefit of priority to Korean Patent Application No. 10-2017-0085288, filed on Jul. 5, 2017 in the Korean Intellectual Property Office, the disclosure of which is incorporated herein by reference in its entirety.

TECHNICAL FIELD

The present disclosure relates to a thin film-type inductor, and particularly, to a high capacity power inductor.

BACKGROUND

Due to high performance implemented in mobile devices such as smartphones and tablet PCs, an AP speed may be increased, while a resolution of an image to be displayed increases. Due to an increase in the power usage as a dual or quad core central processing unit (CPU) is used, a thin film-type inductor mainly used for a DC-DC converter and a noise filter requires low dc resistance to be implemented, with high inductance.

In addition, the miniaturization and thinning of various electronic devices are accelerating with the development of manufacturing technology. Accordingly, a thin film-type inductor used in such electronic devices is also required to be miniaturized and thinned.

To manufacture a small, high capacity thin film power inductor, a coil requires a high aspect ratio, and a body requires a highly charged magnetic sheet. However, even if a high-aspect-ratio coil and a highly charged body are implemented, loss characteristics need to be further improved in order to implement characteristics in a very small size. In detail, in the case of a via pad connecting an upper coil to a lower coil, although the influence on the entire DC resistance (Rdc) is not greatly affected, the characteristic deterioration may be produced through an electrode in the vicinity of the via pad. In addition, since there are limitations in reducing a size of a via, even if a thin film-type power inductor is miniaturized, a ratio of chip charging loss by the via pad tends to be higher as a thin film-type power inductor is miniaturized.

SUMMARY

An aspect of the present disclosure provides a structure preventing a loss of capacity while maintaining and improving electrical characteristics of a thin film-type power inductor, without changing a process to be complicated.

According to an aspect of the present disclosure, a thin film-type inductor includes a body, and a first external electrode and a second external electrode, each disposed on an external surface of the body. The body includes a support member, a first coil and a second coil and a magnetic material surrounding the support member. The first coil has a first end and a second end, and is disposed on an upper surface of the support member. The second coil has a first end and a second end, and is disposed on a lower surface of the support member. The support member includes a through-hole and a via electrode formed therein. A portion of one of an upper surface and a lower surface of the via electrode opposes the magnetic material.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
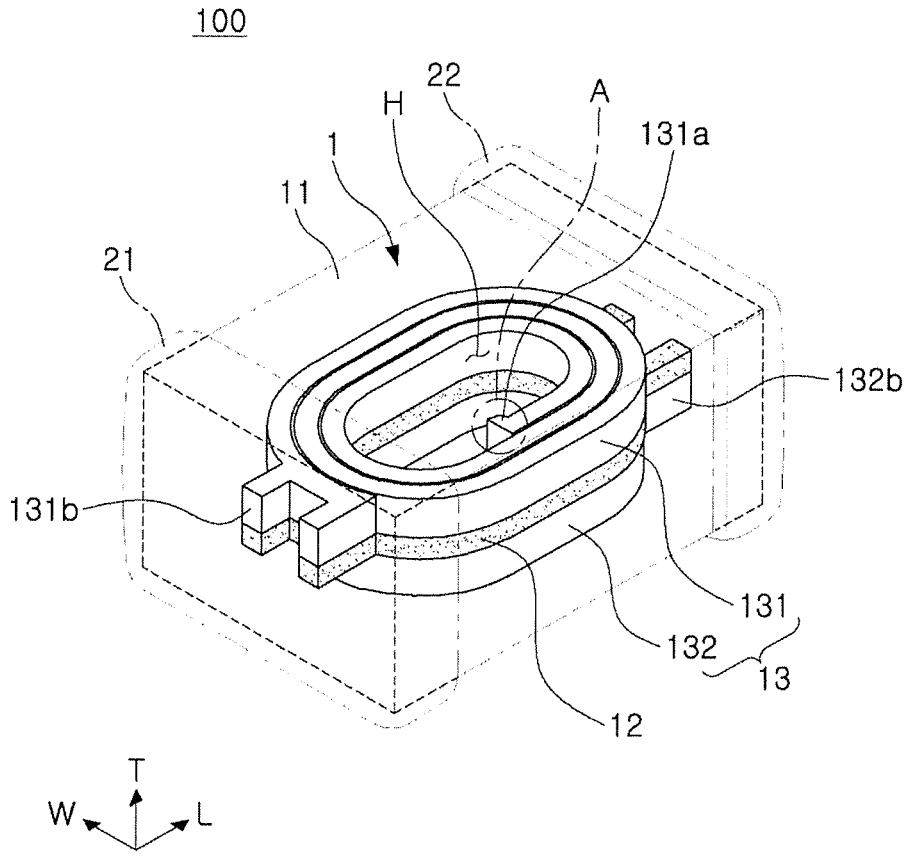
FIG. 1 is a schematic perspective view of a thin film-type inductor according to an embodiment.

Hereinafter, embodiments of the present disclosure will be described as follows with reference to the accompanying drawings. In the accompanying drawings, shapes, sizes and the like, of the components may be exaggerated or shortened for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being 'on,' 'connected to,' or 'coupled to' another element, it can be directly 'on,' 'connected to,' or 'coupled to' the other element or other elements intervening therebetween may be present. In contrast, when an element is referred to as being directly on, 'directly connected to,' or 'directly coupled to' another element, there may be no other elements or layers intervening therebetween. Like numerals refer to like elements throughout. As used herein, the term 'and/or' includes any and all combinations of one or more of the associated listed items.

It will be apparent that although the terms first, second, third, etc. may be used herein to describe various members, components, regions, layers and/or sections, any such members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as 'above,' 'upper,' 'below,' and 'lower' and the like, may be used herein for ease of description to describe one element's relationship relative to another element(s) as shown in the figures. It will be understood that spatially relative terms are intended to encompass different orientations of the device in use or operation, in addition to the orientation depicted in the figures. For example, if the device in the figures is turned over, elements described as 'above,' or 'upper' relative to other elements would then be oriented 'below,' or 'lower' relative to the other elements or features. Thus, the term 'above' can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms 'a,' 'an,' and 'the' are intended to include the plural forms as well, unless the context clearly indicates otherwise. It will be further understood that the terms 'comprises,' and/or 'comprising' when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted alone, in combination or in partial combination.

The contents of the present disclosure described below may have a variety of configurations and propose only a required configuration herein, but are not limited thereto.

Hereinafter, a thin film-type inductor according to an embodiment will be described, but embodiments are not limited thereto.

Thin Film-Type Inductor

Figure 2:
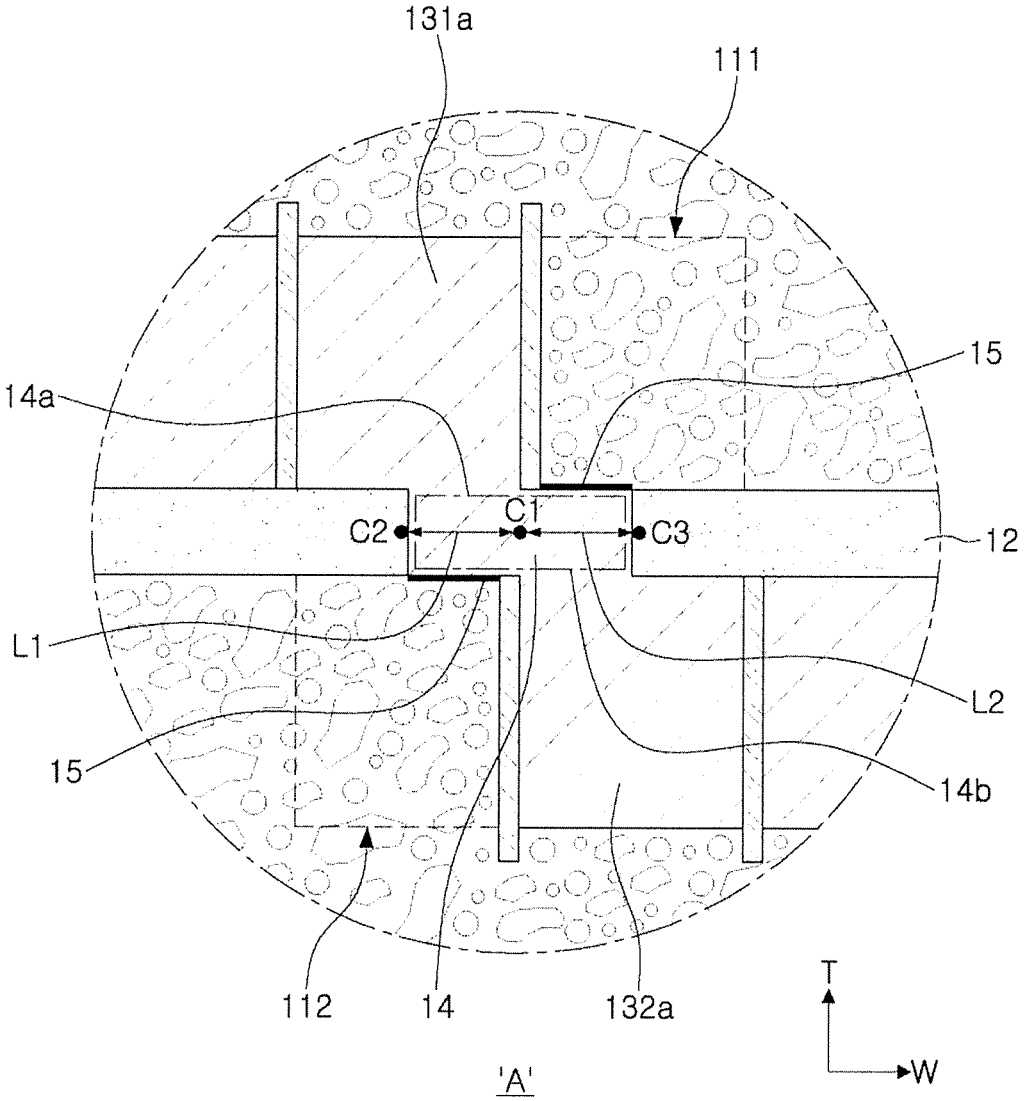
FIG. 2 is a schematic cross-sectional view of an W-T plane with respect to region A of FIG. 1.

FIG. 1 is a schematic perspective view of a thin film-type inductor according to an embodiment, while FIG. 2 is a schematic cross-sectional view of an L-T plane with respect to region A of FIG. 1.

Referring to FIGS. 1 and 2, a thin film-type inductor 100 according to an embodiment includes a body 1, a first external electrode 21 and a second external electrode 22 disposed on an external surface of the body. The body 1 further includes a magnetic material 11 forming an outer cover of the body 1, a support member 12 and a coil 13 sealed by the magnetic material 11. The coil 13 includes a first coil 131 supported by an upper surface of the support member and a second coil 132 supported by a lower surface of the support member 12.

The first external electrode 21 and the second external electrode 22 oppose each other in a length (L) direction of the body 1, and are electrically connected to the first coil 131 and the second coil 132, respectively. The first and second external electrodes 21 and 22 are formed of a material having excellent electrical conductivity. In FIG. 1, the first external electrode 21 and the second external electrode 22 are illustrated as having a "C shape", but embodiments are not limited thereto. Alternatively, the first external electrode and the second external electrode may have an "L shape", or may be formed of a bottom electrode. The first external electrode 21 and the second external electrode 22 need not have the same shape. For example, in an embodiment, the first external electrode 21 is C-shaped and the second external electrode 22 is L-shaped.

The body 1 forms an outer cover of a thin film-type inductor, and may include a first side surface and a second side surface opposing each other in a width (W) direction, a first end surface and a second end surface opposing each other in a length (L) direction, and an upper surface and a lower surface opposing each other in a thickness (T) direction. The various surfaces of the body 1 forma substantially hexahedral shape, but embodiments are not limited thereto.

The magnetic material 11 included in the body 1 may include a material having magnetic properties, and may be formed by filling, for example, a ferrite or metal-based soft magnetic material. The ferrite may include a known ferrite material such as Mn—Zn based ferrite, Ni—Zn based ferrite, Ni—Zn—Cu based ferrite, Mn—Mg based ferrite, Ba based ferrite, Li based ferrite, or the like. The metal-based soft magnetic material may include one or more selected from the group consisting of iron (Fe), silicon (Si), chrome (Cr), aluminum (Al), nickel (Ni), and alloys thereof. For example, the metal-based soft magnetic material may include a Fe—Si—B—Cr based amorphous metal particle, but embodiments are not limited thereto. A particle size of the metal-based soft magnetic material may be 0.1 μm or more to 20 μm or less, and the metal-based soft magnetic material may be included while being dispersed in a polymer such as an epoxy resin, polyimide, or the like.

The first coil 131, the second coil 132, and the support member 12 may be sealed by the magnetic material.

The first coil 131 and the second coil 132 has a spiral shape as a whole, and each of the first coil 131 and the second coil 132 may have a first end and a second end. The first end 131*a* of the first coil 131 is connected to a via electrode 14 for being electrically connected to the second coil 132. The second end 131*b* of the first coil 131 is electrically connected to a first external electrode 21. Similarly, the first end 132*a* of the second coil 132 is connected to the via electrode 14 for being electrically connected to the first coil 131, and the second end 132*b* of the second coil 132 is electrically connected to the second external electrode 22. The first coil 131 and the second coil 132 are thin film-type coils formed while being supported on a support member 12. Although not specifically illustrated, each of the first coil 131 and the second coil 132 are formed of a seed layer and a plating layer disposed above, and an aspect ratio (AR) of the coil is substantially determined by a thickness of the plating layer.

The first end 131*a* of the first coil is formed of a first via pad 14*a*, and the first end 132*a* of the second coil is formed of a second via pad 14*b*. Each of the first via pad 14*a* and the second via pad 14*b*, as a region, of the first coil 131 and the second coil 132, respectively, directly in contact with a via electrode 14, is a portion supporting a via electrode passing through a support member.

A cross section of the first via pad 14*a* and the second via pad 14*b* has a shape of a circle from which at least a portion is removed, for example, a semicircular shape, or a shape whose portion is circular and having a larger area than that of the semicircular shape. In other words, the first via pad 14*a* and the second via pad 14*b* have a cross-section shape of a truncated circle. Typically, via pads have circular cross-sections, and have areas larger than an area of a cross section of the via electrode. In an embodiment, the cross section of the first via pad 14*a* and the second via pad 14*b* has a shape of a circle from which a portion is removed, so a free space to be filled with the magnetic material 11 may be secured, as much as a region having been removed from a circle, compared to the case in which a cross section of the via pads 14*a* and 14*b* has a shape of the circle.

The support member 12 supporting the first coil 132 and second coil 132 has a through-hole H in the center, and an interior of the through-hole is filled with the magnetic material 11 described above, so a core of the coil is provided.

The support member 12 functions to provide a substrate for a coil and to appropriately support the coil. In an embodiment, the support member 12 is provided in the form of a plate with insulation characteristics such as, for example, a PCB substrate, but embodiments are not limited thereto. A thickness of the support member 12 may be sufficient to support the coil (e.g., 131 and/or 132), for example, about 60 μm. The support member 12 may include the via electrode 14 filled with a conductive material, in addition to the through-hole H. A cross section of the via electrode 14 may be substantially circular, but embodiments are not limited thereto. Alternatively, the cross section of the via electrode may have a tapered shape, in which a cross-section area becomes smaller from an external surface of the support member to the center, a reverse tapered shape, or a rectangular pillar shape. In an embodiment, where the cross section of the via electrode 14 is substantially circular, a diameter of the via electrode is 30 μm or more and 100 μm or less. Processing a via hole whose diameter is smaller than 30 μm may be difficult to be precisely controlled due to process variations. When a diameter is larger than 100 μm, an interior of a via hole may not be completely filled with a conductive material, so a via open short may occur.

Referring to FIG. 2, at least a portion of an upper surface, i.e., the portion forming the first via pad 14*a* of the via electrode 14 may oppose the magnetic material 11, and at least a portion of a lower surface, i.e., the portion forming the second via pad 14*b* of the via electrode 14 may oppose the magnetic material 11. In an embodiment, in a manner different from what is illustrated in FIG. 2, a portion of one of the upper surface or the lower surface of the via electrode may also be provided to oppose a magnetic material (not shown). In such embodiments, at least one side of a via electrode "opposing" a magnetic material indicates a structure having at least a surface of a via electrode opposing the magnetic material. It must be noted that a surface of the via electrode opposing the magnetic material does necessarily not indicate that the surface is directly in contact with the magnetic material, but that an additional insulating material may be interposed therebetween. As described above, as at least a portion of one of an upper surface and a lower surface of the via electrode 14 opposes a magnetic material, a space filled with a magnetic material may be significantly increased.

The first end 131*a* of the first coil 131 and a first filling portion 111 formed of the magnetic material 11 are disposed on an upper surface of the via electrode 14. The first end 132*a* of the second coil 132 and a second filling portion 112 formed of the magnetic material 11 are disposed on a lower surface of the via electrode 14. The first filling portion 111 and the second filling portion 112 are a portion of the magnetic material in the body 1.

In a conventional thin film-type inductor, a first via pad, a first end of a first coil, a second via pad, and a first end of a second coil, are located in a region in which the first filling portion and the second filling portion are located. Moreover, conventionally, the first via pad and the second via pad have the same cross section as that of a via electrode disposed in a lower surface or an upper surface, while having a larger area than that of the via electrode. Thus, in conventional thin film-type inductor the first via pad and the second via pad are provided to completely cover the upper surface and the lower surface of the via electrode.

In contrast, in a thin film-type inductor according to an embodiment of the present disclosure, the first via pad 14*a* and the second via pad 14*b* are provided to cover a portion, but not the entirety, of an upper surface or a lower surface of the via electrode disposed in a lower surface or an upper surface. Additionally, a region, not covered by the first via pad 14*a* and the second via pad 14*b*, of the upper surface or the lower surface of the via electrode 14 is provided with the magnetic material 11 disposed therein. As a result, compared to conventional thin film-type inductors, while electrical characteristics of DC resistance (Rdc), and the like are maintained, loss of filling of a magnetic material may be significantly reduced. Thus, in a thin film-type inductor, the first via pad and the second via pad are manufactured to be unnecessarily large, so a structure preventing a via pad portion from acting as the loss of filling a magnetic material may be provided.

Referring back to FIG. 2, an insulating material 15 is disposed between an upper surface of the via electrode 14 and the magnetic material 11 (i.e., a portion of a first filling portion) opposing the same, and an insulating material 15 is disposed between a lower surface of the via electrode 14 and the magnetic material 11 (i.e., a portion of a second filling portion) opposing the same. The insulating material 15 is provided to prevent a short occurring between the magnetic material 11 and the coil 13, and is provided at the same time that a surface of the coil is coated for insulating after the coil is completely formed. A method of forming the insulating material 15 is not particularly limited, and chemical vapor deposition (CVD), sputtering deposition, or the like may be used. A material for the insulating material is sufficient as long as the material has insulating properties. For example, the material may include a phenylene resin or an epoxy resin. Here, the insulating material is further disposed. In this regard, because an additional insulating material is not required to be included, when a via electrode itself or a magnetic material itself has a configuration that enables insulation between the via electrode and the magnetic material.

As for the positional relationship between the via electrode 14 and each of the first coil 131 and the second coil 132, a distance L1 from the center C1 of the via electrode 14 to the center C2 of the first end 131*a* (i.e., the first via pad) of the first coil 131 is substantially the same as a distance L2 from the center C1 of the via electrode 14 to the center C3 of the first end 132*a* (i.e., the second via pad) of the second coil, and has a value greater than 0. Moreover, directions, in which L1 and L2 are extended from the center of the via electrode, are opposite to each other.

In the thin film-type inductor described above, even when a size of a thin film-type power inductor is miniaturized, inductance (Ls) and saturated current (Isat) properties may be improved without loss of electrical characteristics of a chip.

As set forth above, according to an embodiment, a thin film-type power inductor maintaining and improving Ls and Isat characteristics without loss of electrical characteristics of a chip, even when a size of the thin film-type power inductor is miniaturized.

While embodiments have been shown and described above, it will be apparent to those skilled in the art that modifications and variations could be made without departing from the scope of the present invention as defined by the appended claims.

What is claimed is:

1. A thin film-type inductor, comprising:

a body comprising:

a support member having a through-hole, a first coil disposed on an upper surface of the support member, a second coil disposed on a lower surface of the support member, each of the first coil and the second coil including a first end and a second end, and a magnetic material surrounding the support member; and a first external electrode and a second external electrode, disposed on respective external surfaces of the body opposing each other in a length direction, wherein the support member includes a via electrode therein, a portion of the via electrode overlapping the first end of the first coil and a portion of the via electrode overlapping the first end of the second coil are offset in the length direction such that the first end of the first coil connects on a second side of the center of the via electrode, the second side being opposite the first side in the length direction, and the second ends of the first and second coils directly contact a corresponding one of the first and second external electrodes.

2. The thin film-type inductor of claim 1, wherein the upper surface of the via electrode is provided with the first end of the first coil and a first filling portion of the magnetic material, and the lower surface of the via electrode is provided with the first end of the second coil and a second filling portion of the magnetic material.

3. The thin film-type inductor of claim 2, wherein an insulating material is disposed between the first filling portion and the first end of the first coil, and between the second filling portion and the first end of the second coil.

4. The thin film-type inductor of claim 1, wherein the second end of the first coil is connected to the first external electrode and the second end of the second coil is connected to the second external electrode.

5. The thin film-type inductor of claim 1, wherein the first end of the first coil is formed of a first via pad, and a cross section of the first via pad has a shape of a truncated circle.

6. The thin film-type inductor of claim 1, wherein the first end of the second coil is formed of a second via pad, and a cross section of the second via pad has a shape of a truncated circle.

7. The thin film-type inductor of claim 1, further comprising an insulating material disposed in a gap between portions of the upper and lower surfaces of the via electrode and the magnetic material opposing the portions of the upper and lower surfaces.

8. The thin film-type inductor of claim 1, wherein a diameter of the via electrode is 30 μm or more and 100 μm or less.

9. The thin film-type inductor of claim 1, wherein the upper surface of the via electrode is directly connected to the first end of the first coil.

10. The thin film-type inductor of claim 1, wherein the lower surface of the via electrode is directly connected to the first end of the second coil.

11. The thin film-type inductor of claim 1, wherein a shape of a cross section of the first end of the first coil is different from a shape of a cross section of the via electrode.

12. The thin film-type inductor of claim 1, wherein a shape of a cross section of the first end of the second coil is different from a shape of a cross section of the via electrode.

13. The thin film-type inductor of claim 1, wherein an area of a cross section of the first end of the first coil is the same as or smaller than an area of a cross section of the via electrode.

14. The thin film-type inductor of claim 1, wherein an area of a cross section of the first end of the second coil is the same as or smaller than an area of a cross section of the via electrode.

15. The thin film-type inductor of claim 1, wherein a distance between a center of the via electrode and a center of the first end of the first coil is the same as a distance between the center of the via electrode to a center of the first end of the second coil, and the centers of the first end of the first coil and the first end of the second coil are in opposite direction from the center of the via electrode.

16. The thin film-type inductor of claim 1, wherein a width of the first end of the first coil is greater than a width of each coil pattern in a main body of the first coil, and a width of the first end of the second coil is greater than a width of each coil pattern in a main body of the second coil.

17. The thin film-type inductor of claim 1, wherein another part of the via electrode contacts at least a part of the first ends of each of the first and second coils.

18. The thin film-type inductor of claim 1, wherein a portion of one of an upper surface and a lower surface of the via electrode opposes the magnetic.

* * * * *